US010524532B2

(12) United States Patent
Alan et al.

(10) Patent No.: US 10,524,532 B2
(45) **Date of Patent: *Jan. 7, 2020**

(54) COMBINATION SHOE THAT CAN BE TRANSFORMED INTO A SHOE WITH DIFFERENT HEEL HEIGHTS

(71) Applicants: Brad Alan, St. Clair Shores, MI (US); Elizabeth Allen, St. Clair Shores, MI (US)

(72) Inventors: Brad Alan, St. Clair Shores, MI (US); Elizabeth Allen, St. Clair Shores, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/948,399

(22) Filed: Apr. 9, 2018

(65) Prior Publication Data

US 2018/0220732 A1 Aug. 9, 2018

Related U.S. Application Data

(63) Continuation of application No. 14/991,490, filed on Jan. 8, 2016, now Pat. No. 9,936,761.

(Continued)

(51) Int. Cl.
*A43B 3/24* (2006.01)
*A43B 21/36* (2006.01)

(Continued)

(52) U.S. Cl.
CPC ..... *A43B 3/24* (2013.01); *A43B 3/246* (2013.01); *A43B 21/36* (2013.01); *A43B 21/37* (2013.01);

(Continued)

(58) Field of Classification Search
CPC ..... A43B 3/24; A43B 3/246; A43B 21/36; A43B 21/37; A43B 21/39; A43B 21/42;

(Continued)

(56) References Cited

U.S. PATENT DOCUMENTS 1,268,199 A 6/1918 Zayarkin
1,493,565 A 5/1924 Raboni (Continued)

FOREIGN PATENT DOCUMENTS

RU 2008778 3/1994
WO 2014/020175 A1 2/2014

OTHER PUBLICATIONS

International Search Report and Written Opinion for PCT/2016/046772, dated Dec. 29, 2016, ISA/RU.

(Continued)

*Primary Examiner* — Ted Kavanaugh
(74) *Attorney, Agent, or Firm* — The Dobrusin Law Firm, PC

(57) ABSTRACT

A shoe assembly includes a front sole section, a rear sole section, a heel, and a hinge. The front sole section has a front sole section rear edge. The rear sole section includes a rear sole section front edge, a shank, and a release button. The heel may be removably attached to the shank and may be released from a locked position by the release button. The hinge connects the front sole section and the rear sole section. The hinge is perpendicular to a rear sole section axis.

11 Claims, 24 Drawing Sheets

Related U.S. Application Data

Figure 1:
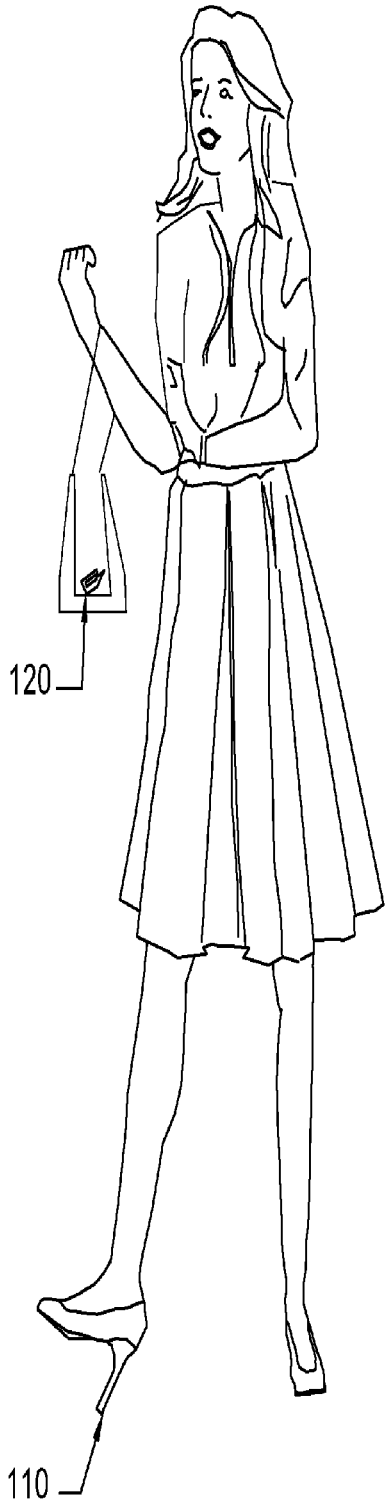

(60) Provisional application No. 62/282,824, filed on Aug. 13, 2015.

(51) Int. Cl.
*A43B 21/48* (2006.01)
*A43B 21/433* (2006.01)
*A43B 21/37* (2006.01)
*A43B 21/39* (2006.01)

(52) U.S. Cl.
CPC ..... *A43B 21/39* (2013.01); *A43B 21/433* (2013.01); *A43B 21/48* (2013.01)

(58) Field of Classification Search
CPC ..... A43B 21/433; A43B 21/437; A43B 21/48; A43B 21/50; A43B 21/51; A43B 21/52
USPC ..... 36/100, 36 R, 36 B, 36 C, 41, 42, 43
See application file for complete search history.

(56) References Cited

U.S. PATENT DOCUMENTS 1,528,265 A 3/1925 Roa
2,129,099 A 9/1938 Pearson
2,157,818 A 5/1939 Disch
2,177,571 A 10/1939 Kirke
2,184,209 A 12/1939 Burger
2,239,471 A 4/1941 Srajer
2,450,250 A 9/1948 Napton
2,466,580 A 4/1949 Dalbey
2,478,664 A 8/1949 Morrow
2,509,423 A 5/1950 Cramer
2,590,648 A 3/1952 Pitz
2,599,970 A 6/1952 Barrons
2,707,341 A 5/1955 Romano
2,517,472 A 8/1958 Fathauer
3,032,895 A 5/1962 Goldberg
3,144,722 A 8/1964 Cortina
3,152,408 A 10/1964 Thiessen
3,171,962 A 3/1965 Ballinger
3,178,835 A 4/1965 Burke et al.
3,266,177 A 8/1966 Holden
3,455,038 A 7/1969 Kasdan
3,464,126 A 9/1969 Sarkissian
3,478,447 A 11/1969 Gillead
3,481,053 A 12/1969 Felice
4,059,910 A 11/1977 Bryden et al.
4,272,897 A 6/1981 Ponce
4,416,072 A 11/1983 Sarkissian
4,670,996 A 6/1987 Dill
5,079,857 A 1/1992 Clifton
5,309,651 A 5/1994 Handel
5,347,730 A 9/1994 Rodriguez Colon
5,410,820 A 5/1995 Goodman
5,456,026 A 10/1995 Lewis
5,477,625 A 12/1995 Goldsmith et al.
5,524,365 A 6/1996 Goldenberg
5,953,836 A 9/1999 Watt et al.
6,631,570 B1 10/2003 Walker
7,185,448 B2 3/2007 Schupbach
7,578,075 B1 8/2009 Kemp
7,954,256 B2 6/2011 Colella
7,975,405 B1 7/2011 Kemp
8,046,936 B1 11/2011 Simon
8,051,586 B2 11/2011 Auger et al.
8,112,908 B2 2/2012 Visser
8,132,341 B1 3/2012 Laramore
8,201,347 B2 6/2012 Garza
8,215,036 B2 7/2012 Auger et al.
8,220,183 B2 7/2012 Evans et al.
8,424,224 B2 4/2013 Hampton
8,453,345 B2 6/2013 Evans et al.
8,458,927 B2 6/2013 Santos
8,505,218 B2 8/2013 Angiulo et al.
8,657,110 B2 2/2014 Angiulo et al.
8,832,968 B2 9/2014 Terrida
8,832,972 B2 9/2014 Kemp
8,850,722 B2 10/2014 Baker et al.
8,850,723 B2 10/2014 Greene et al.
8,925,218 B2 1/2015 Anderson
8,938,891 B2 1/2015 Kemp et al.
9,009,990 B2 4/2015 Angiulo et al.
9,119,437 B2 9/2015 Weller et al.
9,215,909 B2 12/2015 Saccullo et al.
9,226,547 B2 1/2016 Pitcock et al.
9,936,761 B2 * 4/2018 Alan ..... A43B 21/433
2001/0052195 A1 12/2001 Blakey
2006/0075662 A1 4/2006 Schupbach
2008/0235991 A1 10/2008 Visser
2008/0244931 A1 10/2008 Gallegos
2009/0183391 A1 7/2009 Gallegos
2010/0139123 A1 6/2010 Alan et al.
2013/0247412 A1 9/2013 Du Coeur
2014/0298685 A1 10/2014 Alan
2016/0183625 A1 6/2016 Rezvi
2016/0198795 A1 7/2016 Lopez-Velasquez

OTHER PUBLICATIONS

Extended European Search Report dated Feb. 28, 2019, Application No. 16835977.6.

* cited by examiner

SIDE VIEW

SIDE VIEW

COMBINATION SHOE THAT CAN BE TRANSFORMED INTO A SHOE WITH DIFFERENT HEEL HEIGHTS

CROSS-REFERENCE TO RELATED APPLICATIONS

This application claims the benefit of U.S. Provisional Application No. 62/282,824 filed on Aug. 13, 2015 of which are incorporated herein by reference in their entirety.

FIELD

The present invention relates to shoes generally and, more particularly, to a transformable shoe having a sole that allows different height heels to be detached and/or attached easily.

BACKGROUND

This section provides background information related to the present disclosure which is not necessarily prior art.

Shoes as conventionally manufactured cannot transform into shoes with varying heel heights or no heel at all. The reason for this problem is the current manufacturing process. Currently high heels are permanently attached to the sole of the shoe. The heels cannot be removed unless they are broken away from the sole. A shoe with a broken high heel is unwearable for any walking distance.

Conversely shoes without heels or low style shoes cannot be transformed into high heels or any other heel height. Currently the manufacturing process does not allow for shoes to be transformed into any style shoe other then what they are. The walking motion of high heel shoes is different than the walking motion of low style shoes. The walking motion of high heel shoes involves putting more weight on the ball of the foot and toes. The toe portion of the shoe comes in contact with the floor surface at the same time as the heel. The downward pressure of the person's weight is thrust down on the ball and toes of the foot.

High heel shoes can only be worn for a limited time due to this said downward pressure on the ball and toes of the foot. A person can only wear high heel shoes for only so many hours. After a time, discomfort sets in. The downward pressure on the ball and toes of the foot cause this discomfort. The person either has to stop walking or take off the high heel shoes. After the person cannot wear the high heel shoes, they have either the choice of changing shoes or removing them and going barefoot.

Also, it is difficult for a person to wear high heel shoes on a bus, or a train, walking across a parking lot, getting in and out of a car, up and down staircases, on a slippery floor, outdoors in the rain or snow, etc. The surface area that comes in contact with the floor or ground of a high heel shoe is very small. The high heel surface area combined with the toe area of the shoe is very small as compared with that of a low style shoe. Also, when walking the downward pressure of the weight on the high heel can be very unstable on a slippery, wet, icy, uneven, or hilly surface. Wearing high heels on any of surfaces can be very difficult or even dangerous.

A high heel is used by people for certain occasions, and a low style shoe is used for other occasions. When a person goes out to a formal affair, they will need to wear high heel shoes. Formal affairs include weddings, concerts, dates, etc. The formal occasions usually include dancing. Women love to dance in high heels. Then, later that night their feet hurt and they cannot continue to wear the high heel shoes. The high heel shoes are taken off because of the discomfort. At the end of a night of dancing you see a lot of women walking around barefoot. The problem being a person has to carry two sets of shoes or walk around barefoot carrying the shoes.

Low style shoes are worn on other occasions. These other occasions usually involve a lot of walking or time spent on ones feet. These other occasions can include work, school, shopping, strolling, etc. The walking motion in a low style shoe involves making an initial contact of the walking surface with the heel. The heel the floor or ground first. The weight is then transferred to the toe portion of the shoe as each step is taken. This is a more natural motion of walking than that of a high heel shoe.

Arch support is required in the normal walking motion within the shoe. This occurs in a normal foot between the ball of the foot and the end of the heel area. There is an arch in a foot that must be supported. In conventional shoe design there is a raised arch in the sole of the shoe to support this natural arch in the foot. A high heel must absorb the downward weight of the person. When standing or walking in high heels the person's weight is concentrated on the central part of the heel and the ball of the foot.

High heel shoes can be worn for only a limited amount of time, but are require at certain occasions. Low style shoes can be worn for a much longer period of time and are worn for other occasions. The problem with conventional shoes is that a person needs two pairs of shoes and this is not always the case. An example of this situation is a person is at work wearing their low style shoes and receives an invitation to go to a formal affair that requires high heel shoes. The person needs to go home or shopping to obtain a pair of high heel shoes.

It would be desirable to have a transformable shoe having a sole that allows different height heels to be detached and/or attached easily.

SUMMARY

This section provides a general summary of the disclosure, and is not a comprehensive disclosure of its full scope or all of its features.

The present invention concerns a shoe assembly including a front sole section, a rear sole section, a heel, and a hinge. The front sole section has a front sole section rear edge. The rear sole section includes a rear sole section front edge, a shank, and a release button. The heel may be removably attached to the shank and may be released from a locked position by the release button. The hinge connects the front sole section and the rear sole section. The hinge is perpendicular to a rear sole section axis.

The objects, feature, and advantages of the present invention including proving a transformable shoe having a sole that allows different height heels to be detached or attached easily that may (i) include a shank configured to interlock with a heel being attached, (ii) form a truss with a support rod securing a heel that has been attached, (iii) change angle to orient to different height heels, (iv) provide a quick release mechanism that facilitates heel changes, (v) be implemented as a customizable shoe kit, and/or (vi) provide a wearer with a shoe that can change heel height.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

These and other objects, features and advantages of the present invention will be apparent from the following detailed description and the appended claims and drawings in which:

FIG. 1: a view of a person wearing high heels and carrying the low heels in a purse.

Figure 2:
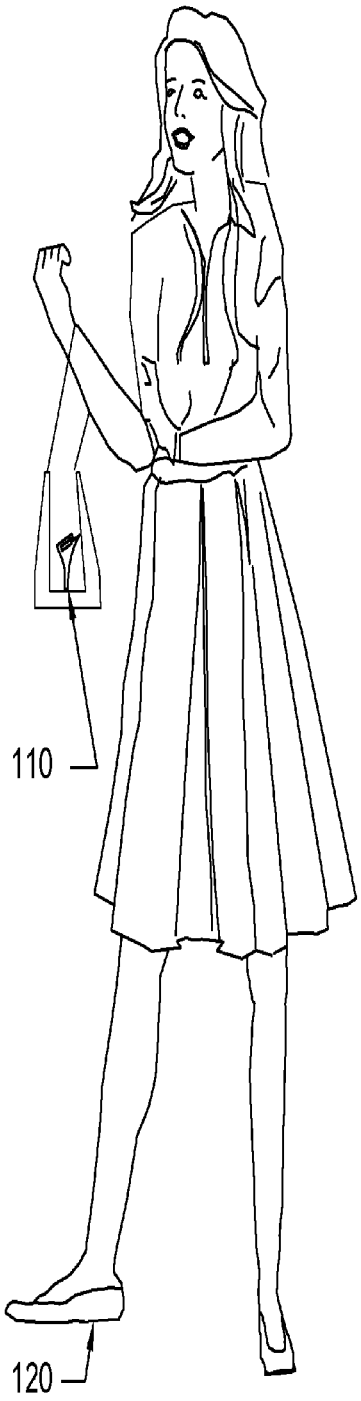

FIG. 2: a view of a person wearing low heels and carrying the high heels in a purse.

Figure 3:
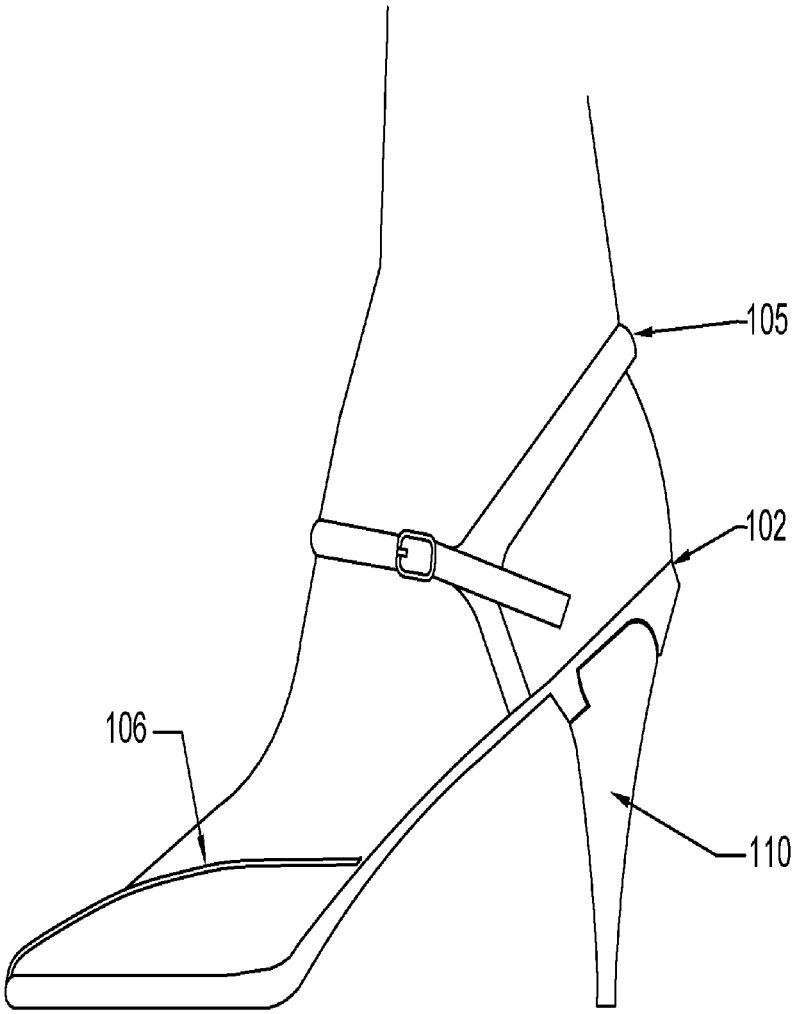

FIG. 3: an elevation view is shown. The high heel is fully inserted into the rear sole.

Figure 4:
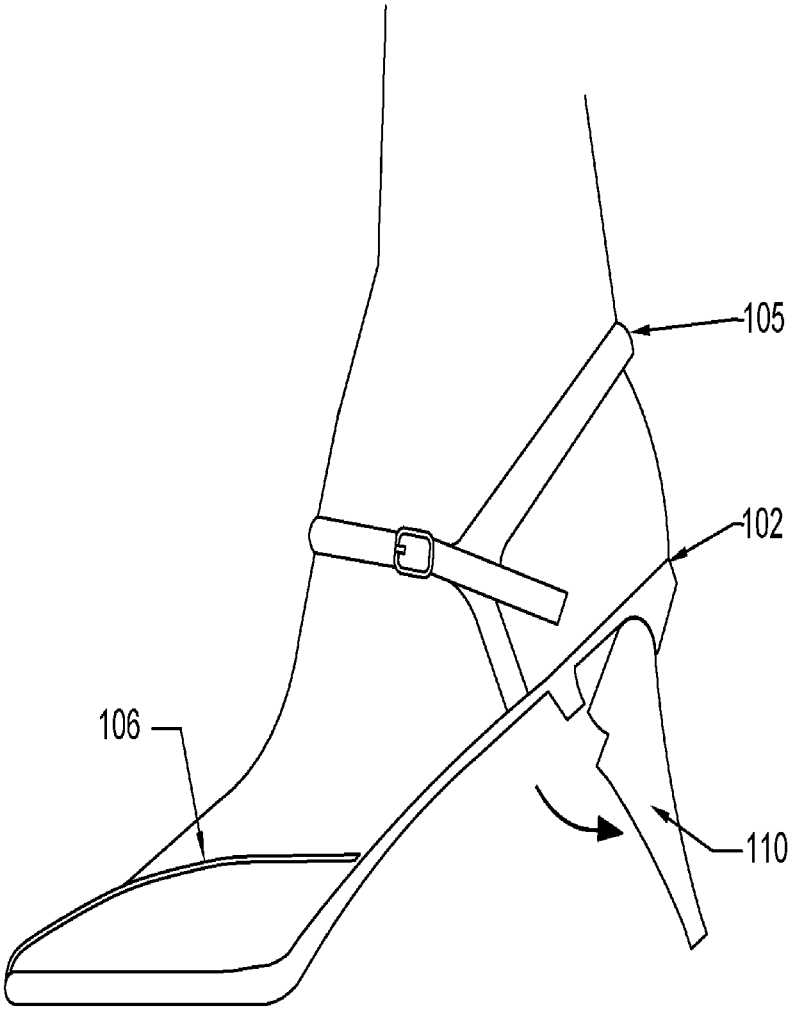

FIG. 4: an elevation view is shown. The high heel is being rotated.

Figure 5:
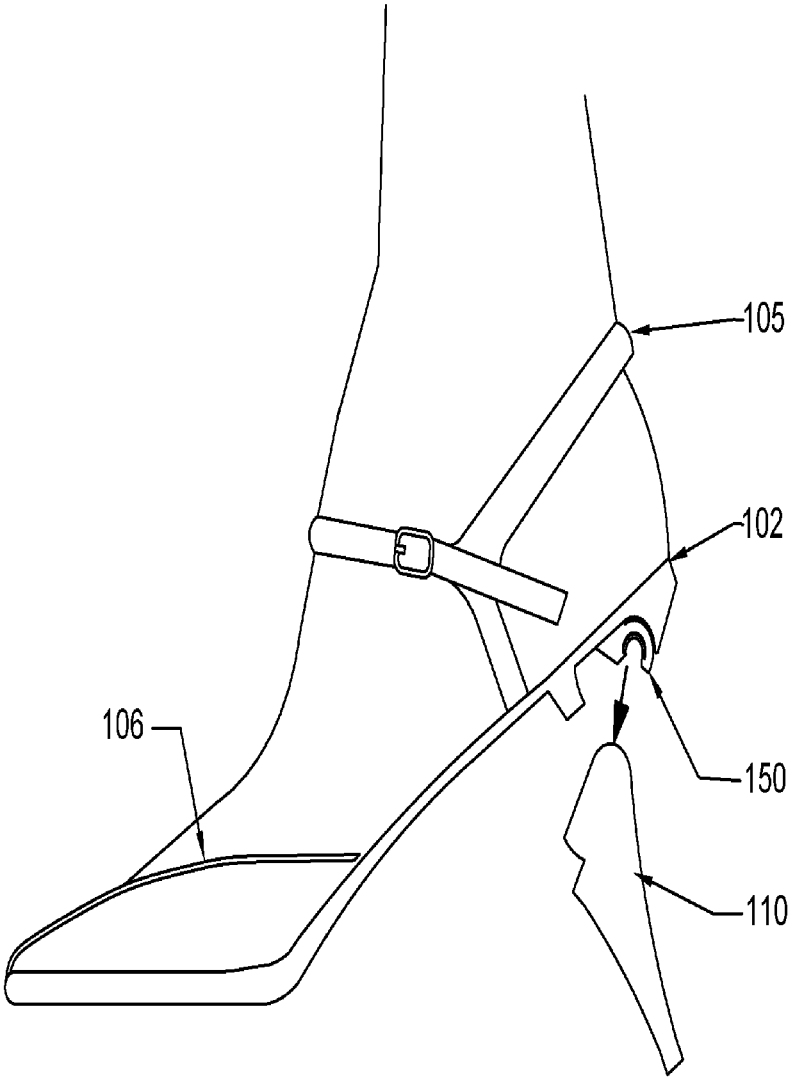

FIG. 5: an elevation view is shown. The high heel is being removed from the shank.

Figure 6:
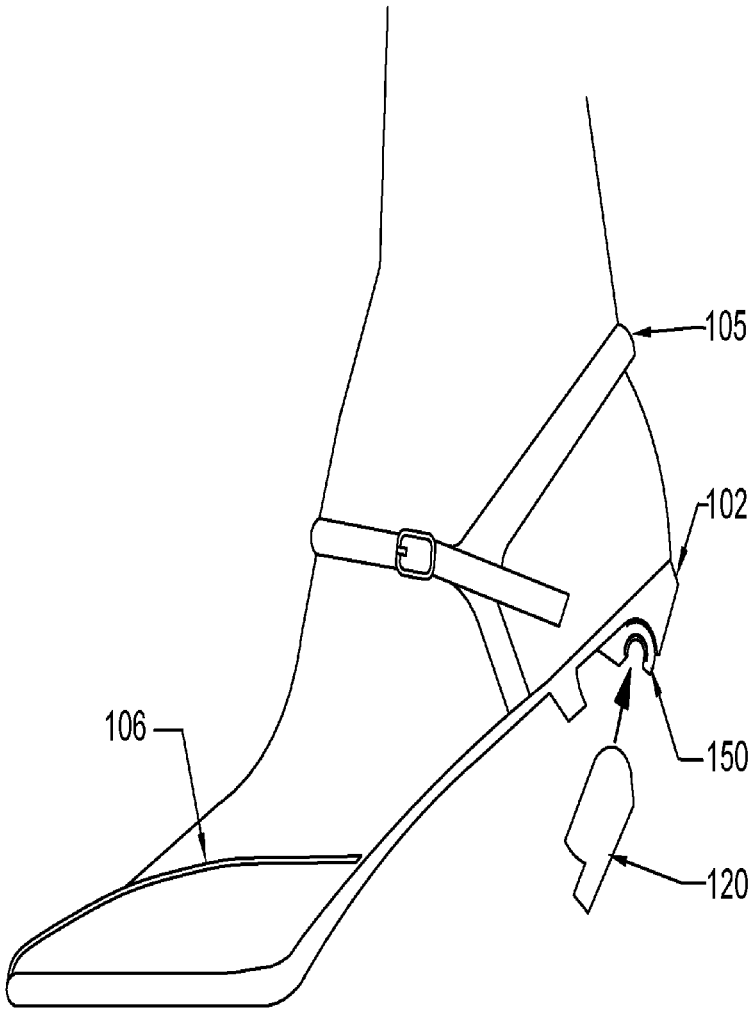

FIG. 6: an elevation view is shown. The low heel is being inserted.

Figure 7:
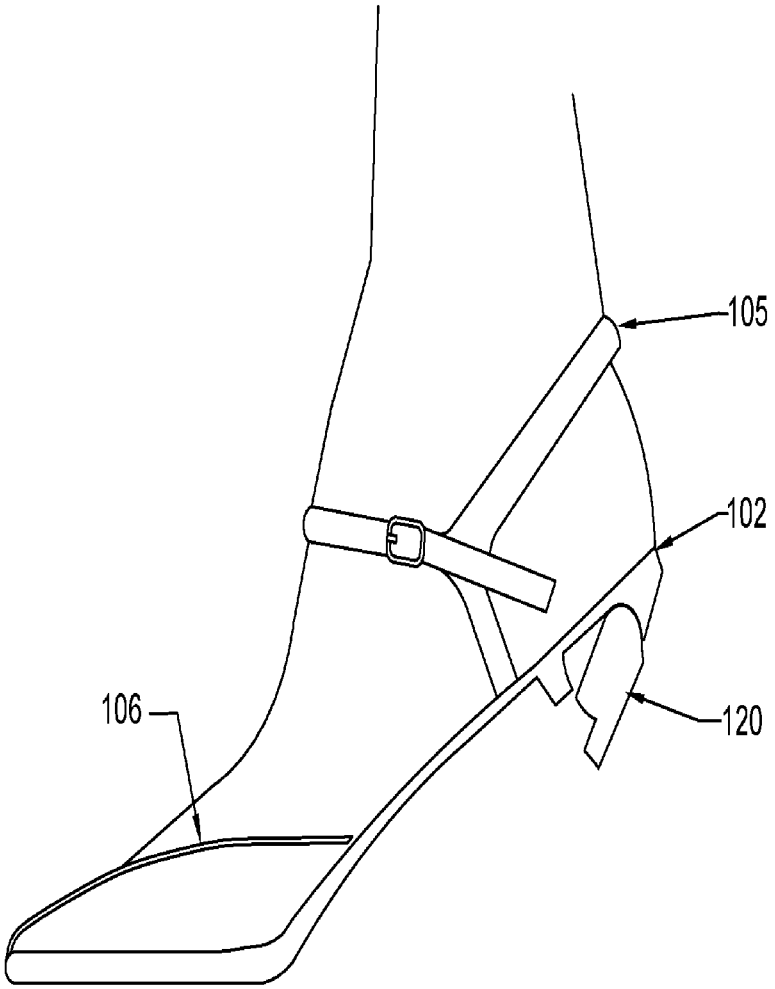

FIG. 7: an elevation view is shown. The low heel is inserted.

Figure 8:
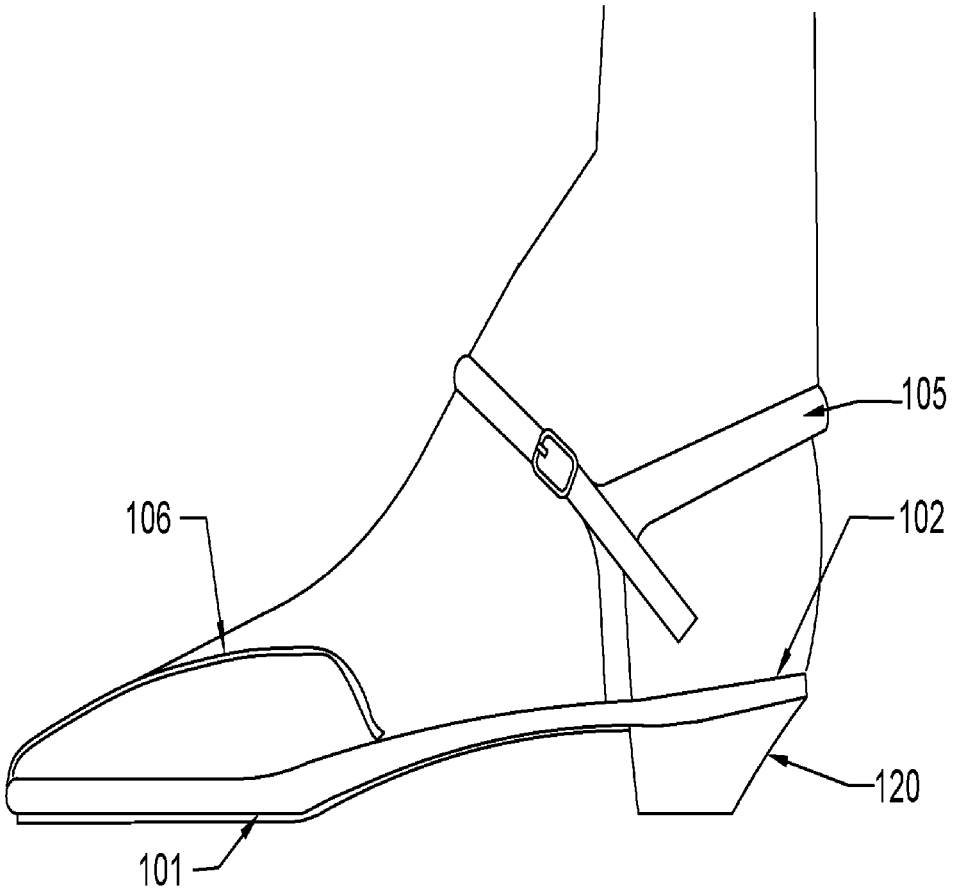

FIG. 8: an elevation view is shown. The shoe is shown in the low position.

Figure 9:
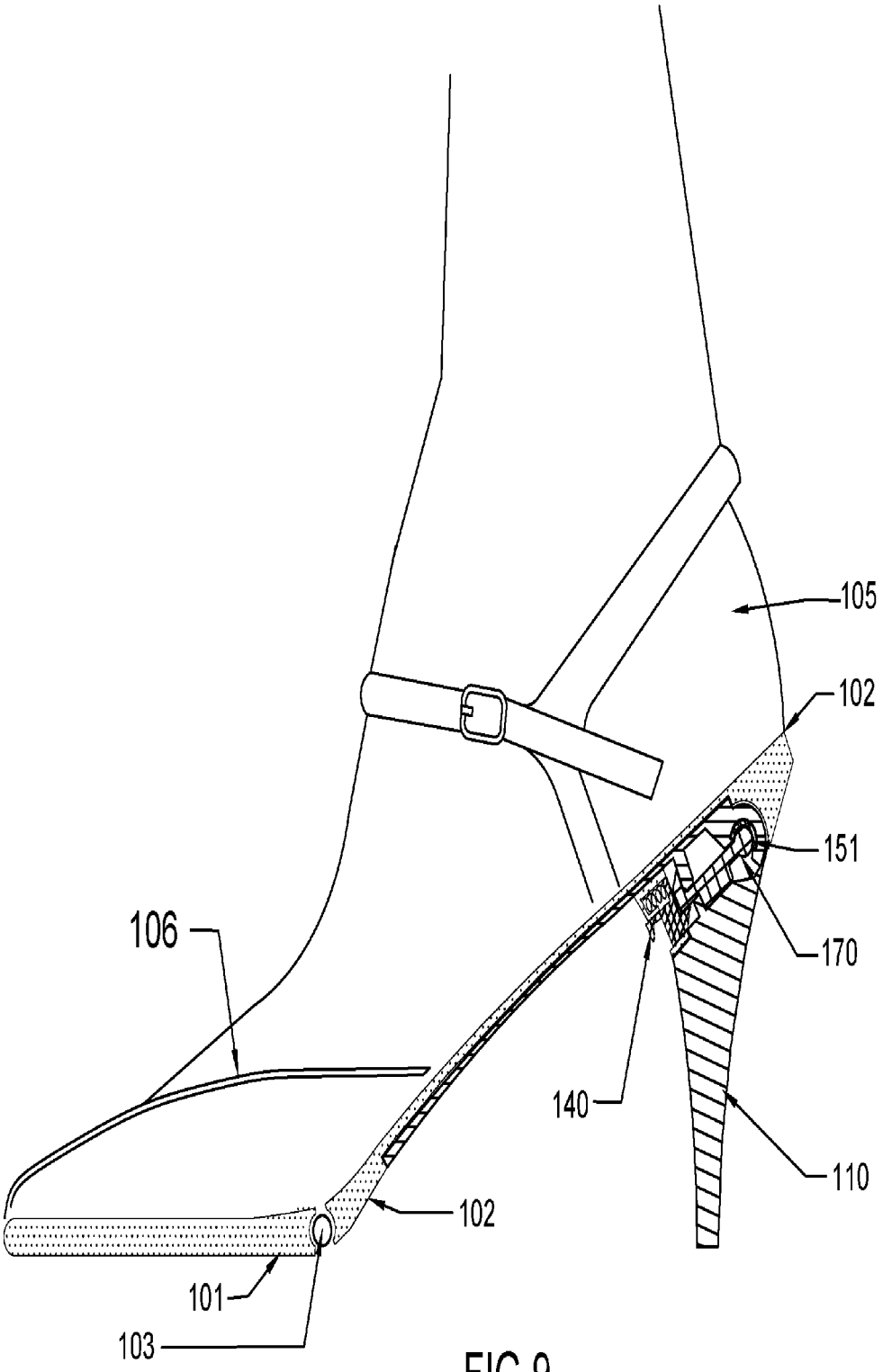

FIG. 9: a section view is shown. The high heel is fully inserted into the shank. The button is in the locked position.

Figure 10:
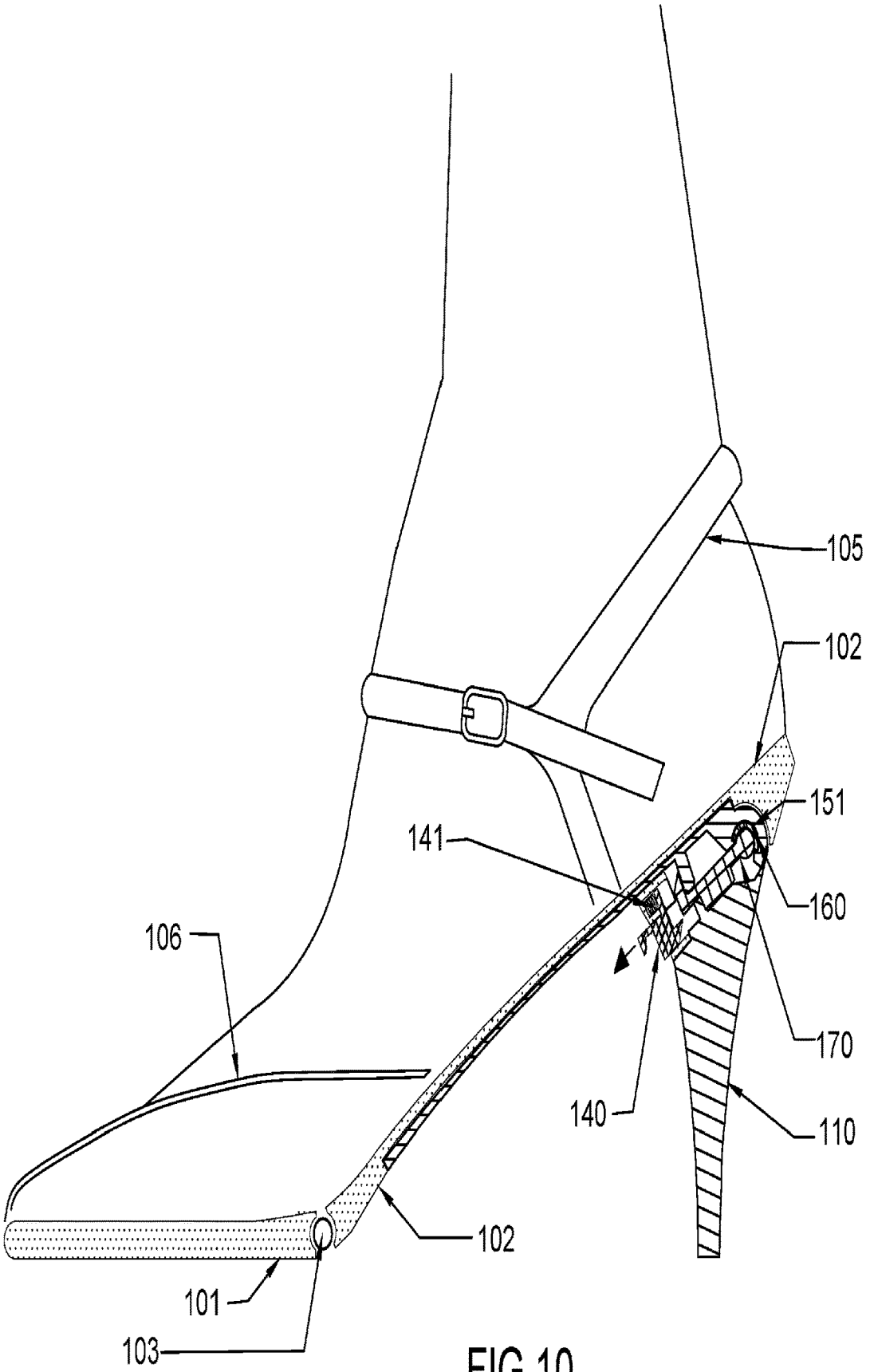

FIG. 10: a section view is shown. The button is being pulled out to the unlocked position.

Figure 11B:
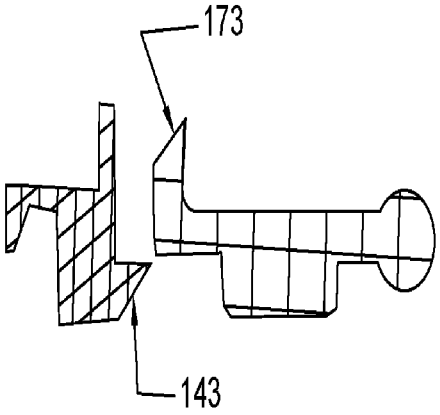
Figure 11A:
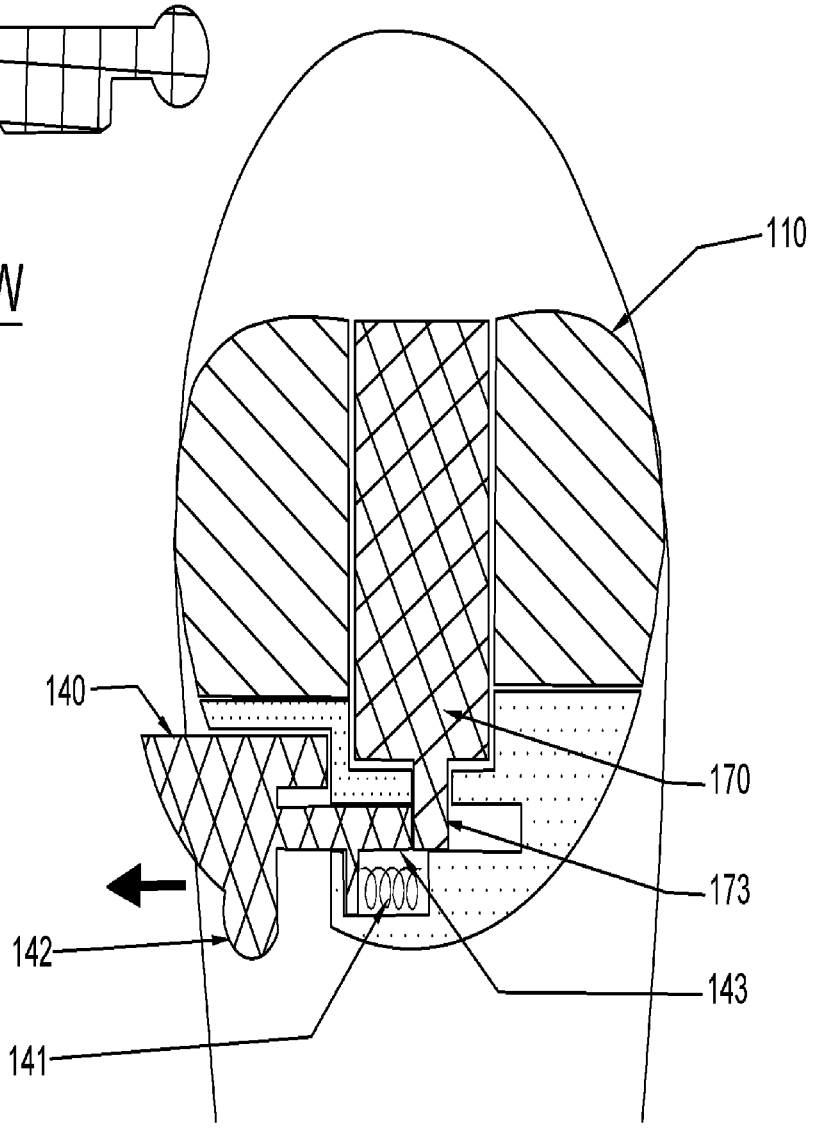

FIGS. 11A and 11B represent sectional views of the shoe engagement system with an engagement button is being pulled out to the unlocked position.

Figure 12:
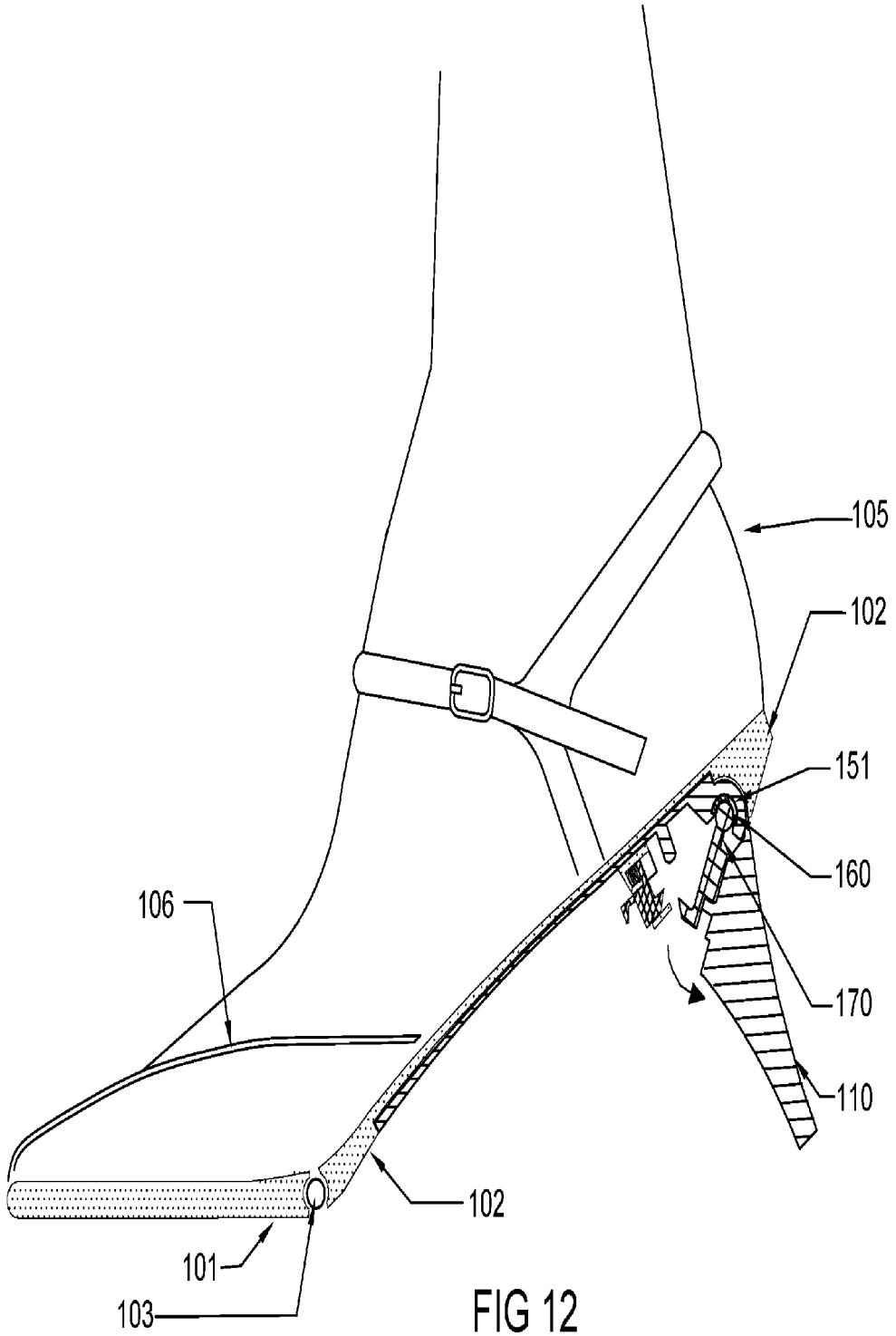

FIG. 12: a section view is shown. The high heel is being rotated.

Figure 13:
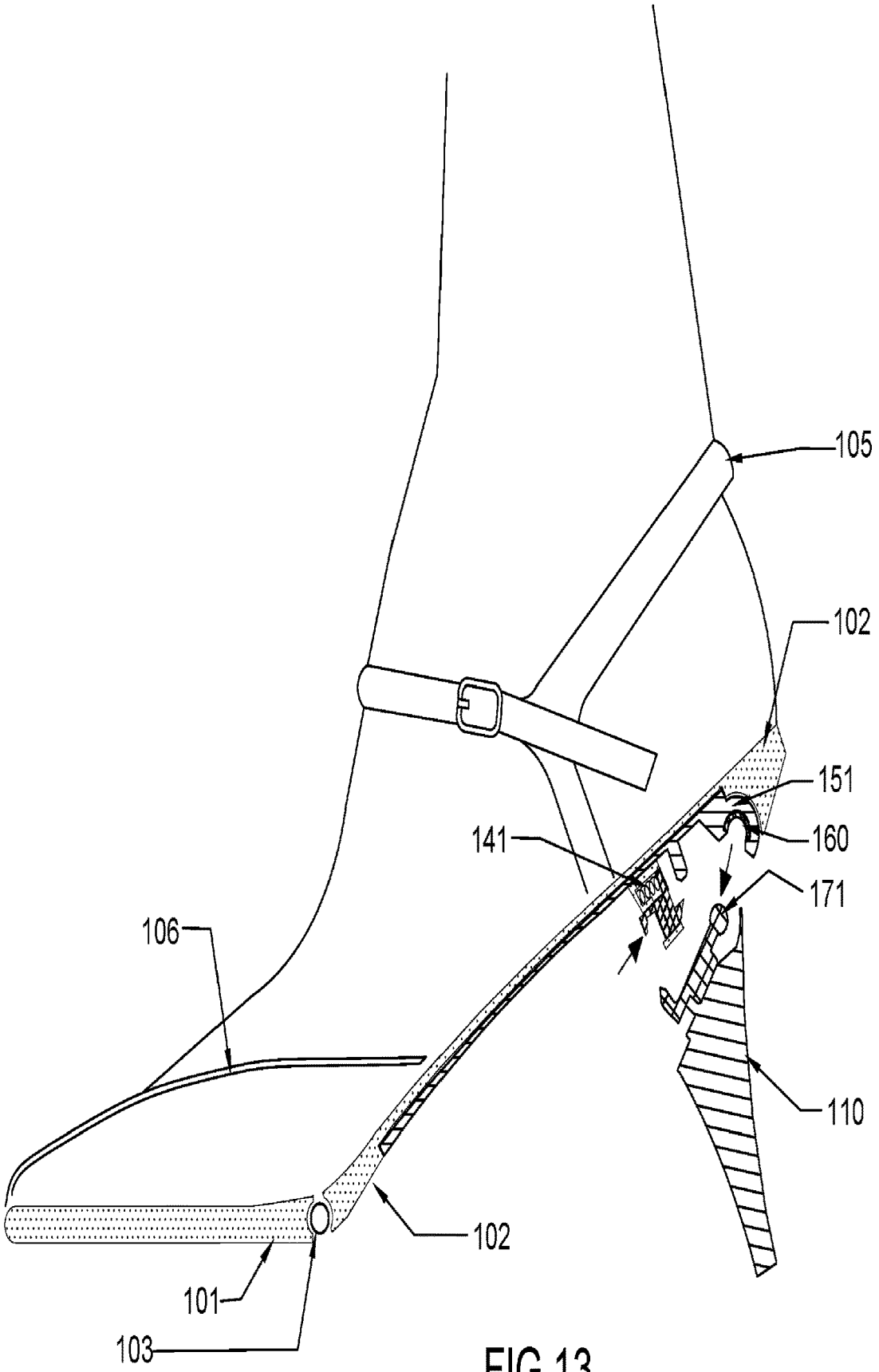

FIG. 13: a section view is shown. The high heel is being removed from the shank.

Figure 14:
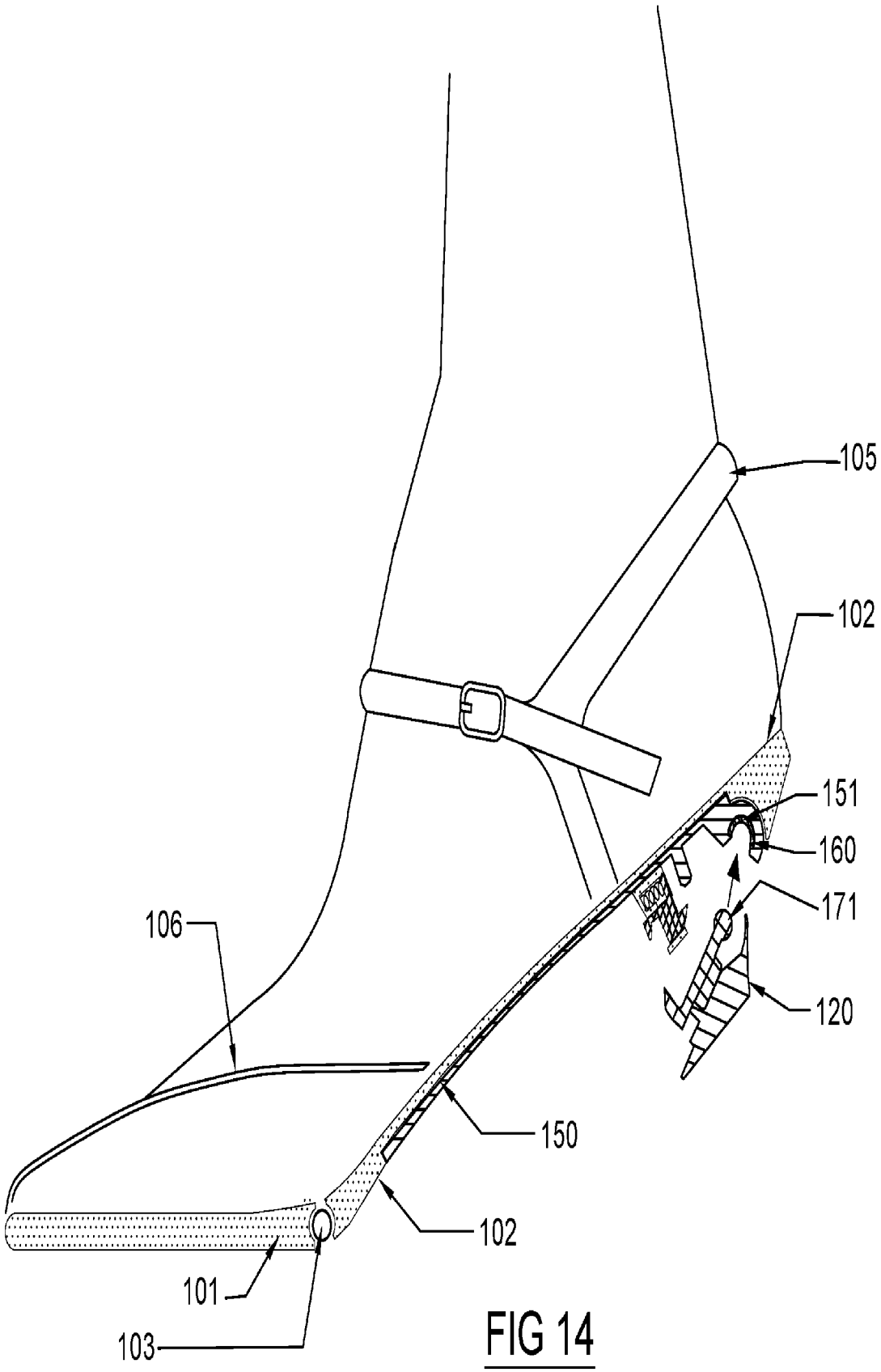

FIG. 14: a section view is shown. The button is in the locked position. The low heel is being inserted.

Figure 15:
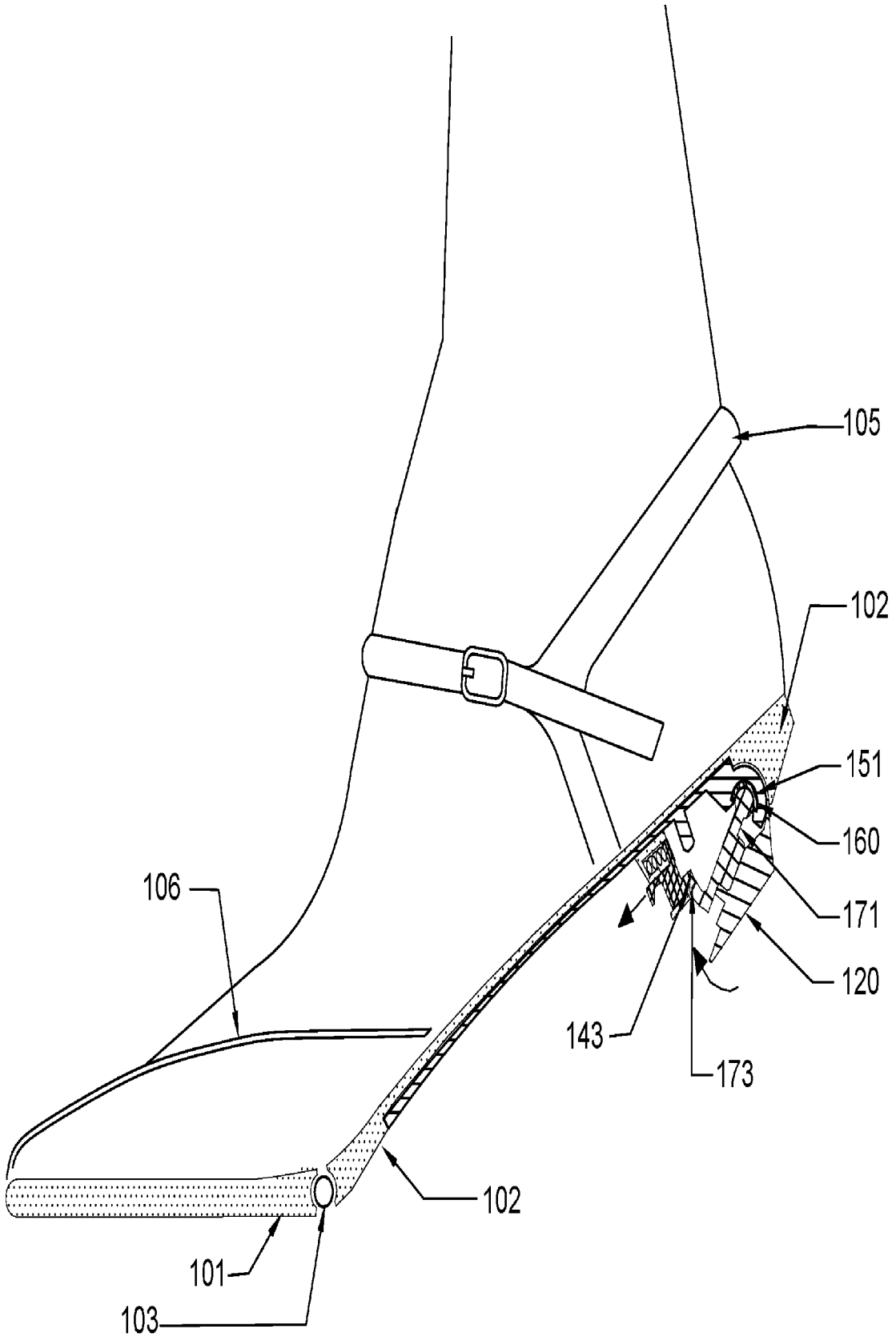

FIG. 15: a section view is shown. The low heel is inserted and being rotated up.

Figure 16:
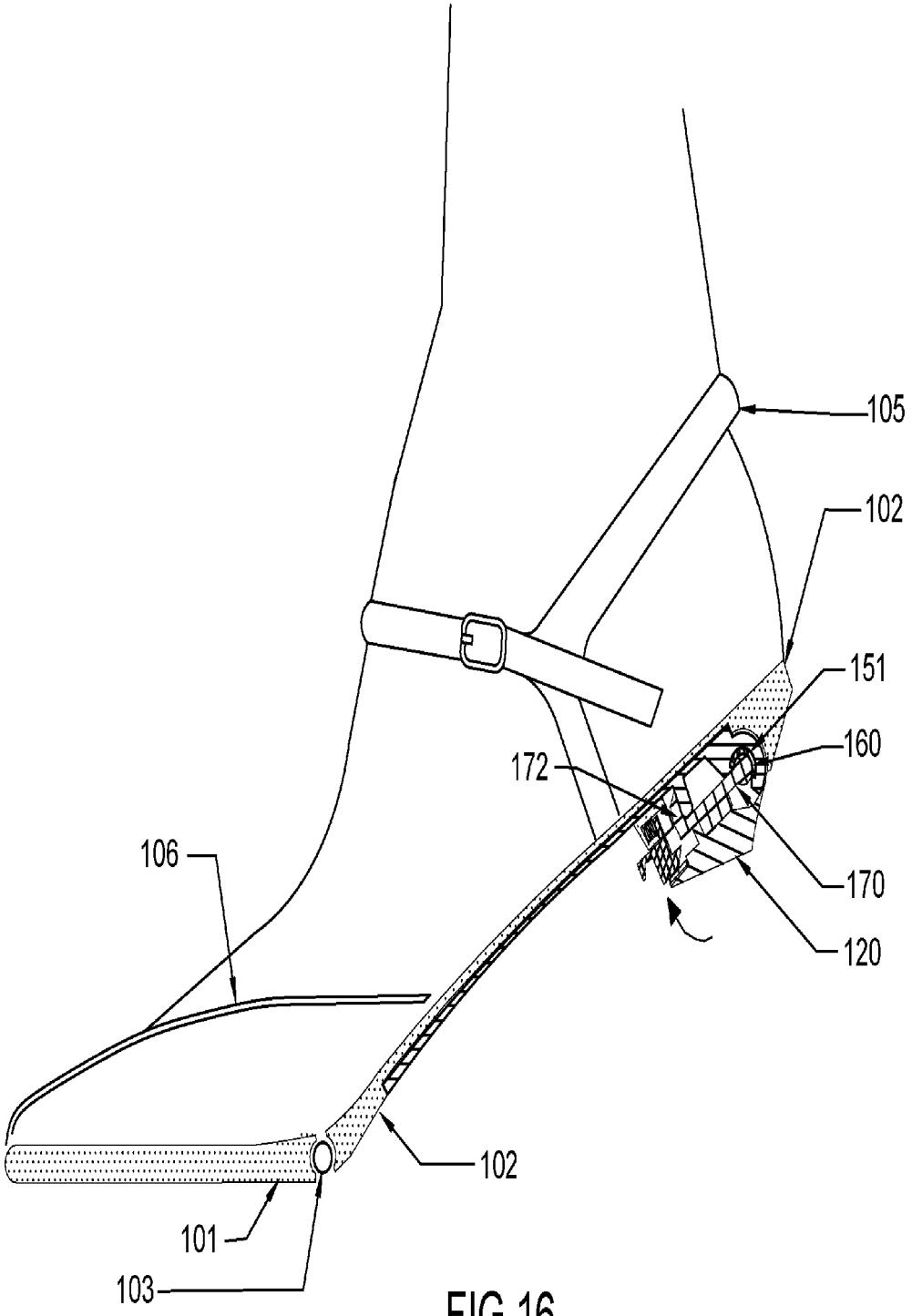

FIG. 16: a section view is shown. The button has been sprung to the unlocked position.

Figure 17:
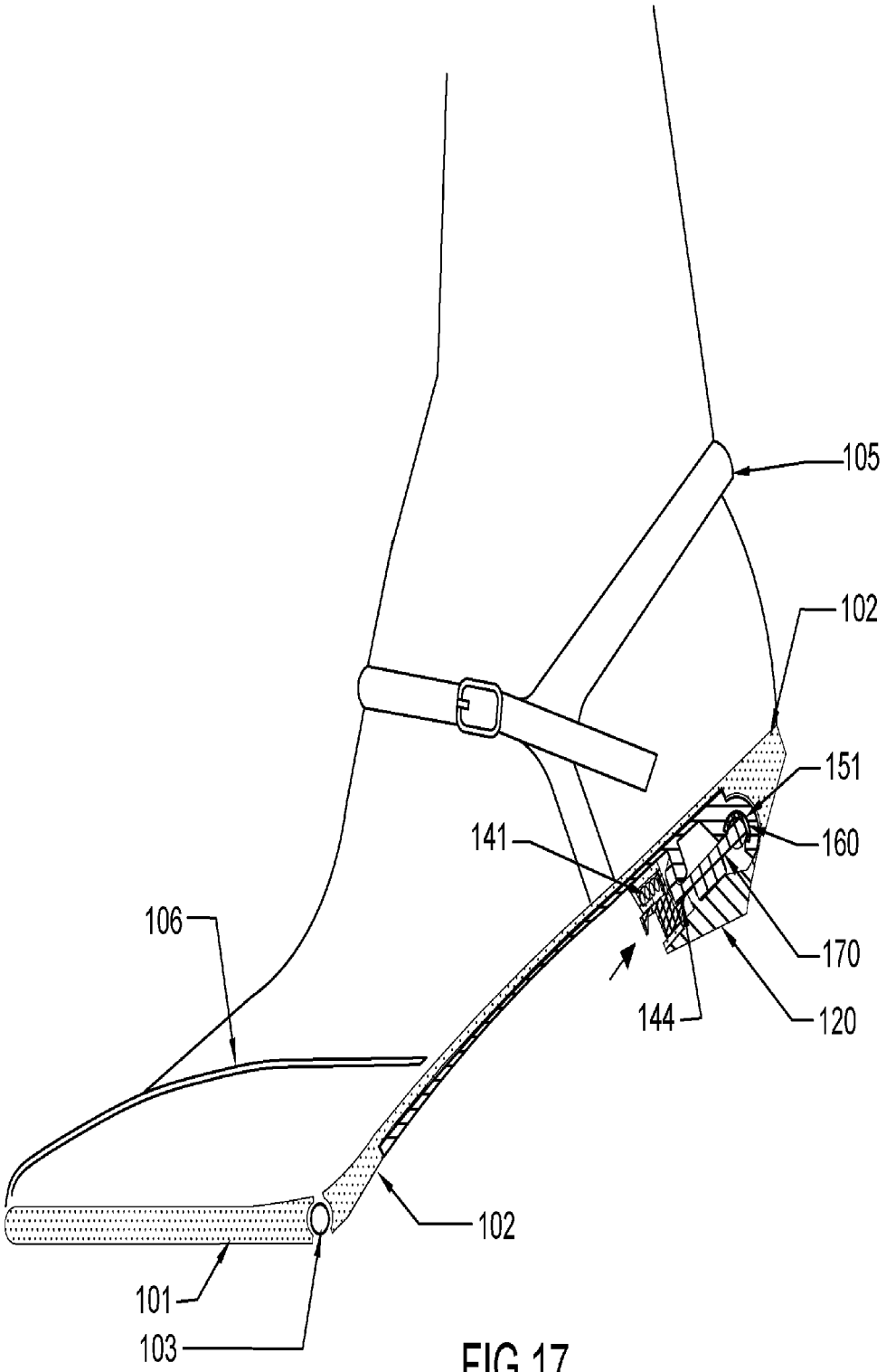

FIG. 17: a section view is shown. The button lock has engaged the heel hinge which locks the low heel.

Figure 18B:
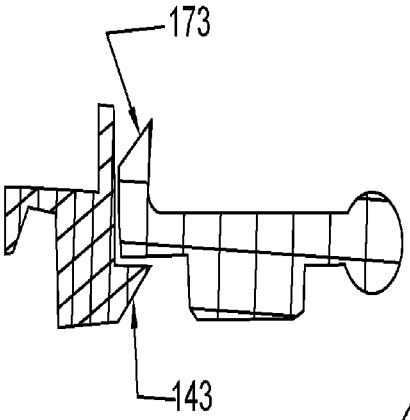
Figure 18A:
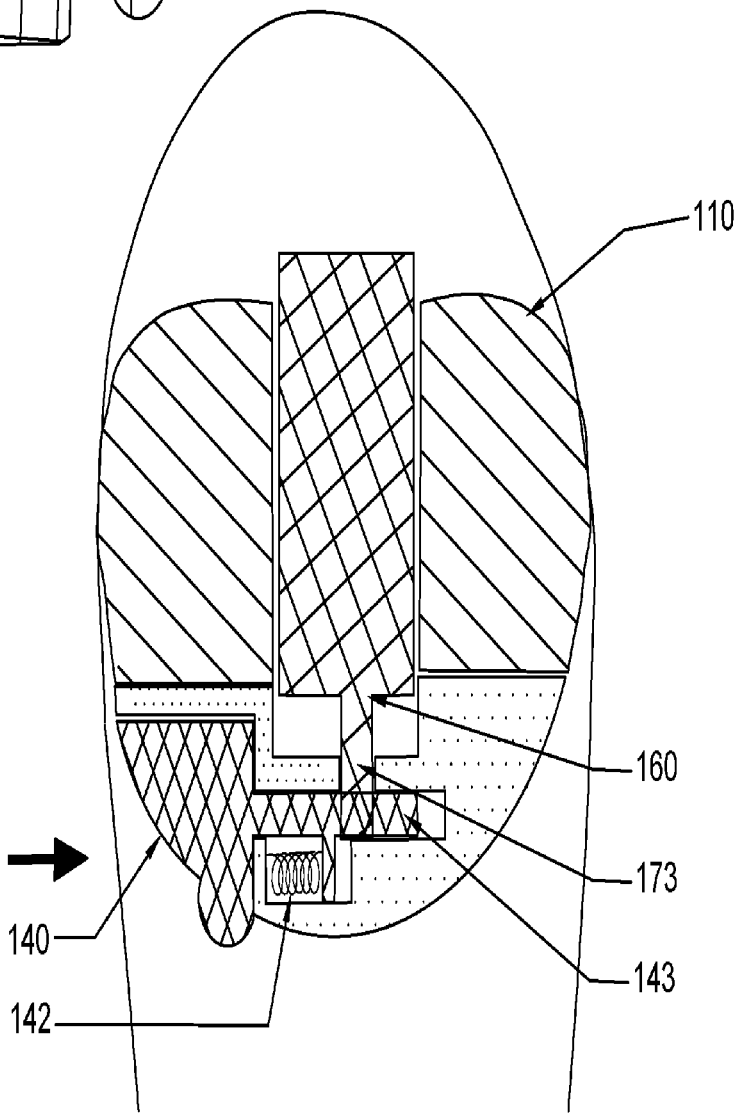

FIGS. 18A and 18B represent sections views with the button has been sprung to the locked position.

Figure 19:
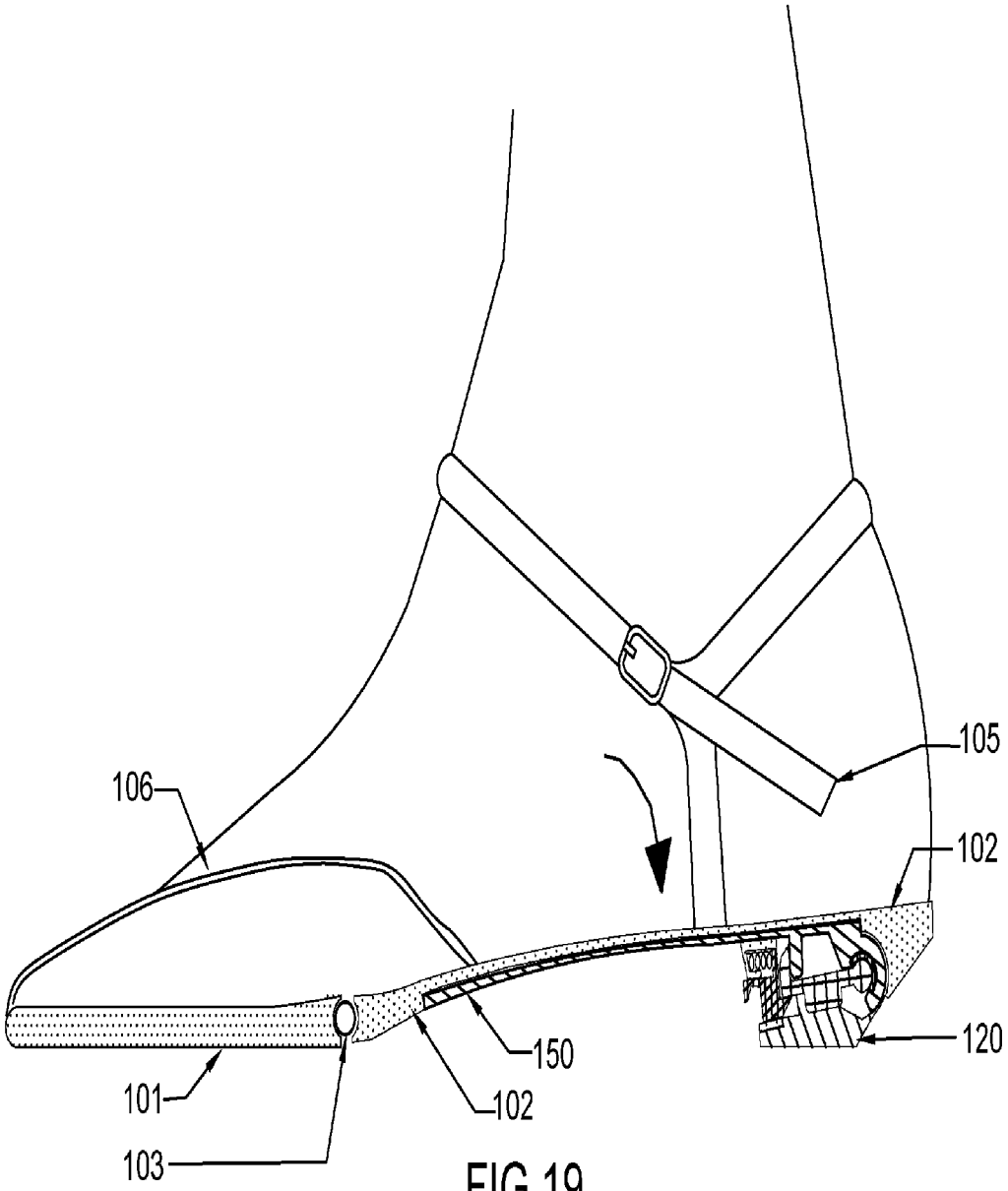

FIG. 19: a section view is shown. The rear sole has been rotated to the low heel position.

Figure 20:
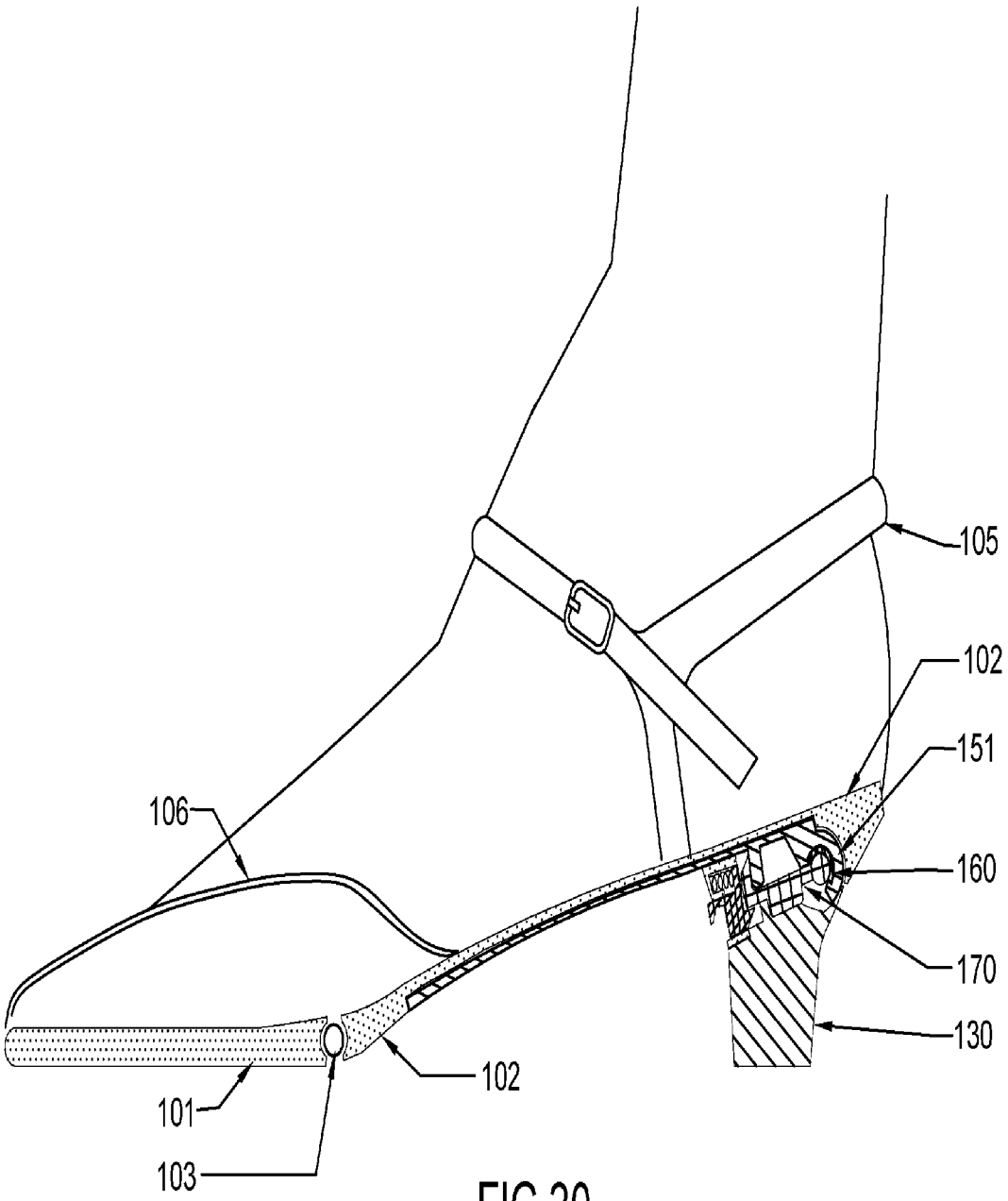

FIG. 20: a section view is shown. The mid heel has been inserted and rotated up.

Figure 21:
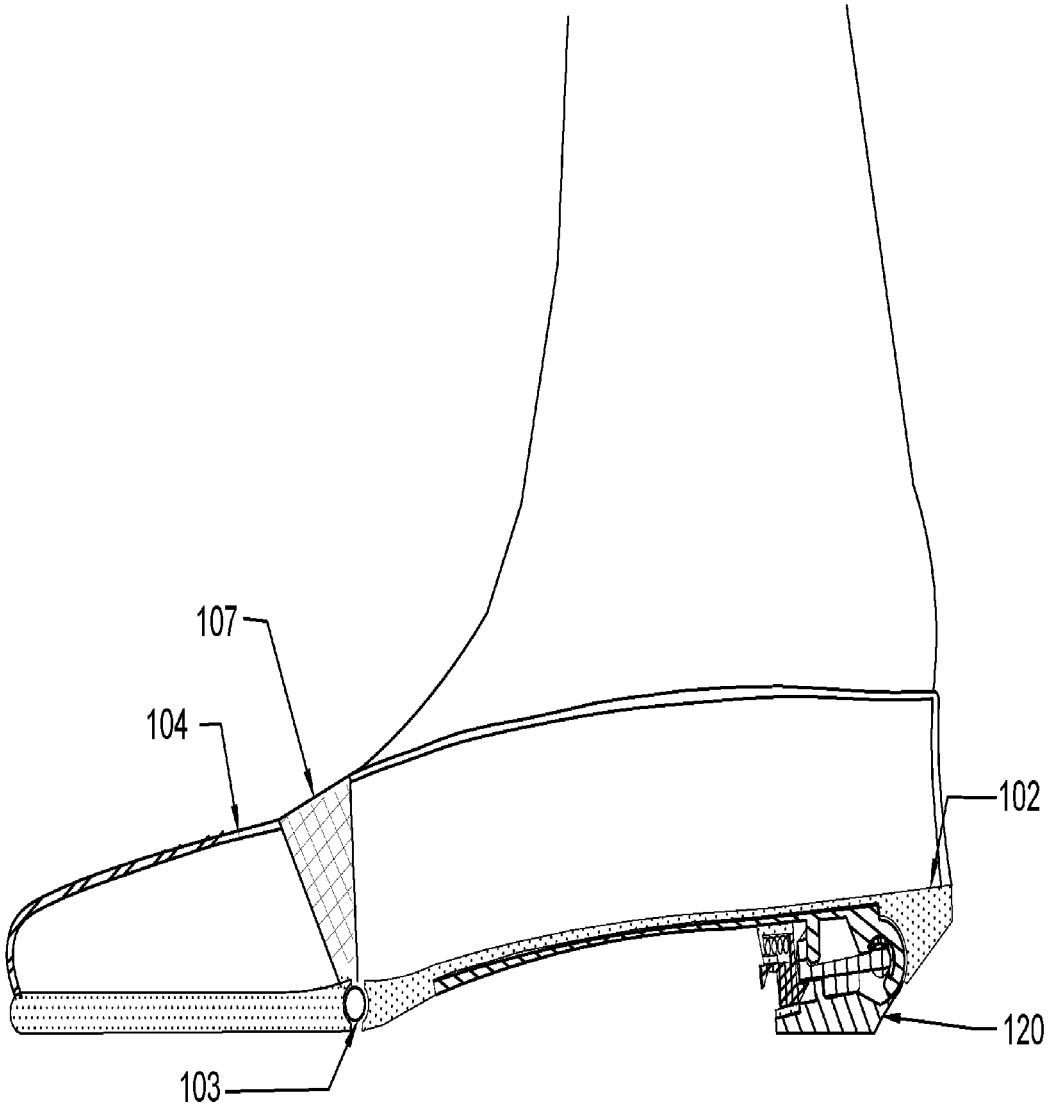

FIG. 21: a section view is shown. The rear sole has been rotated to the low heel position. The shoe elastic has been stretched.

Figure 22:
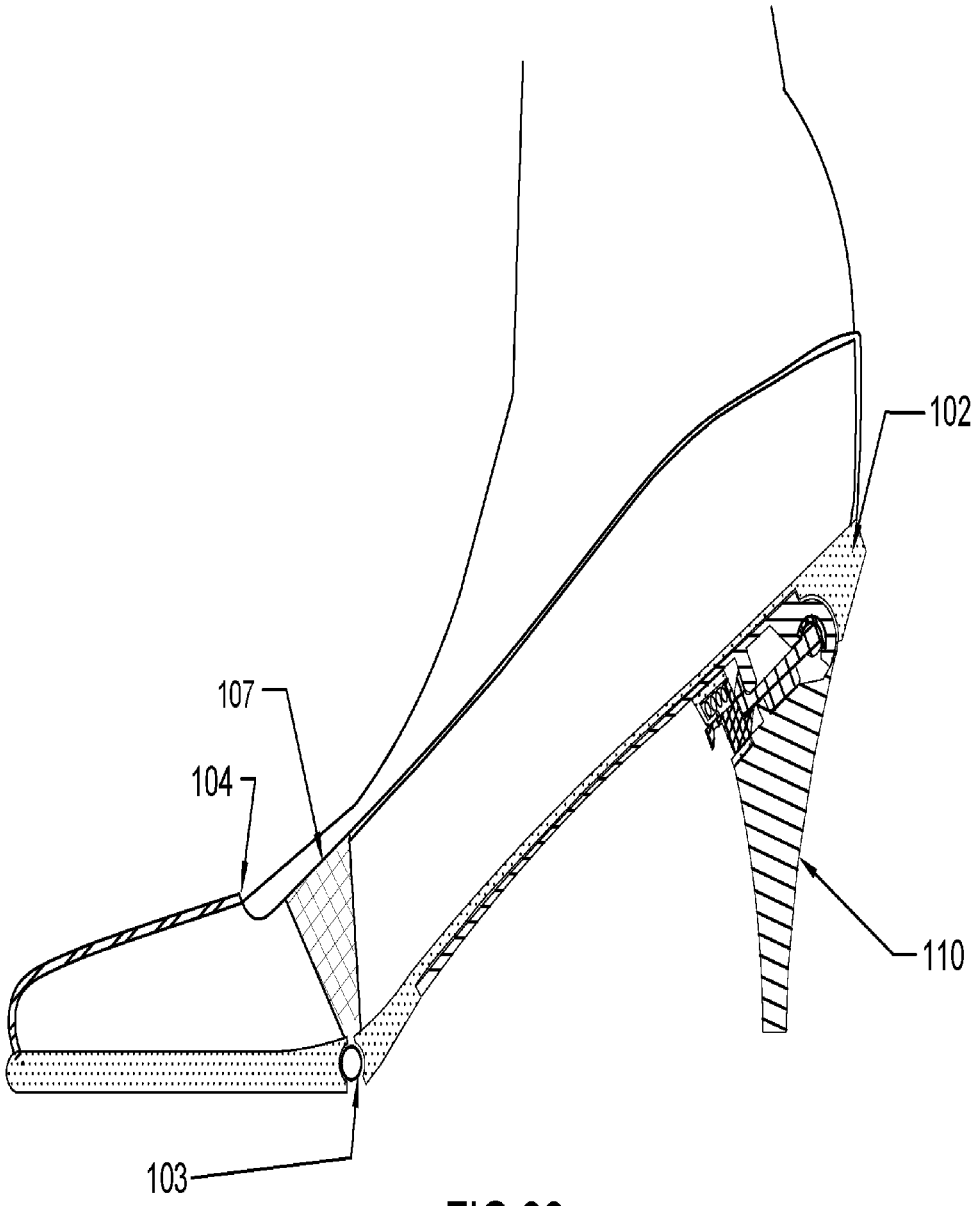

FIG. 22: a section view is shown. The rear sole has been rotated to the high heel position. The shoe elastic has been compressed to accommodate the fully body shoe in the high heel position.

Figure 23:
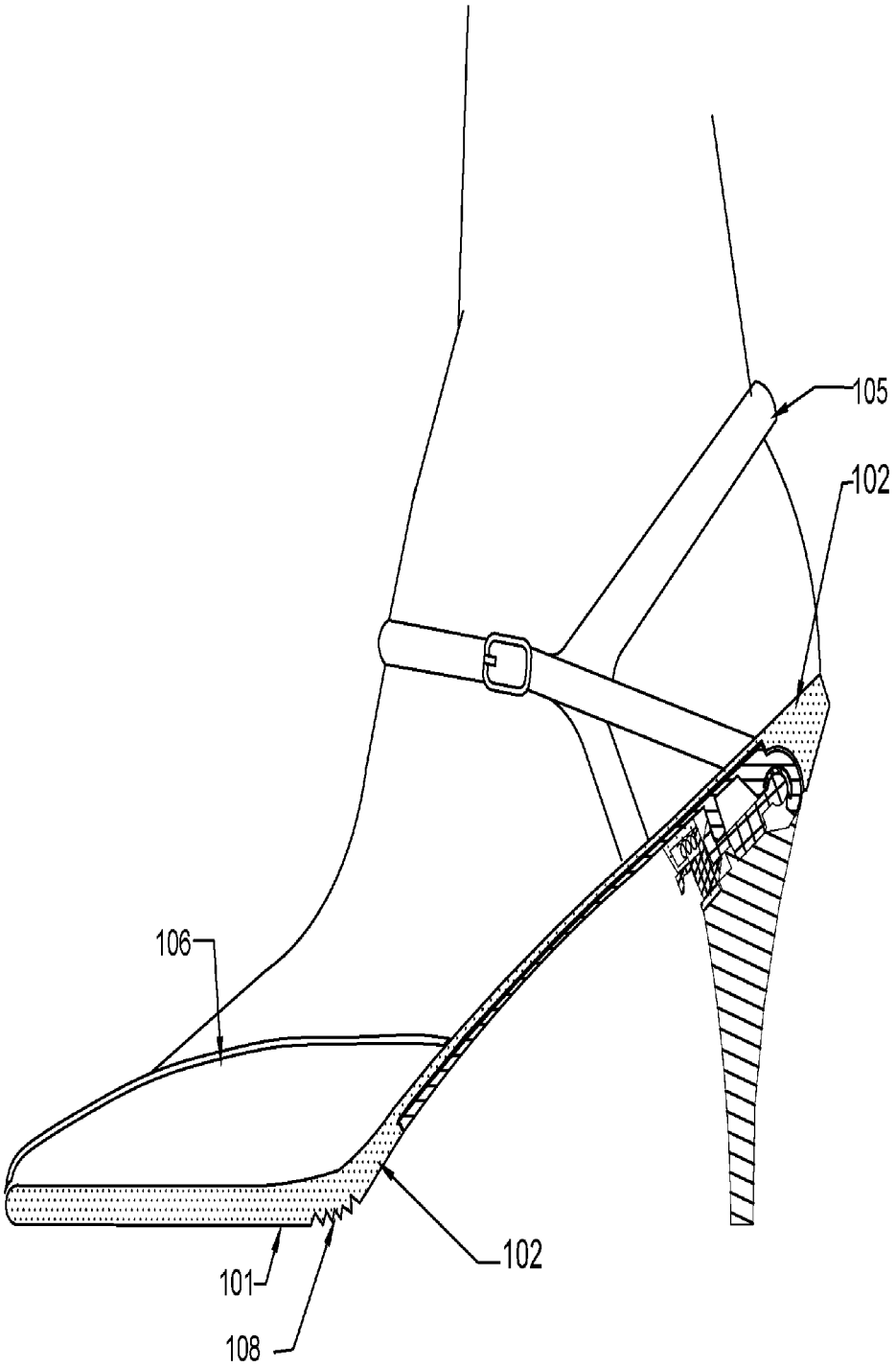

FIG. 23: a section view is shown. The rear sole has been rotated to the high heel position using the living hinge.

Figure 24:
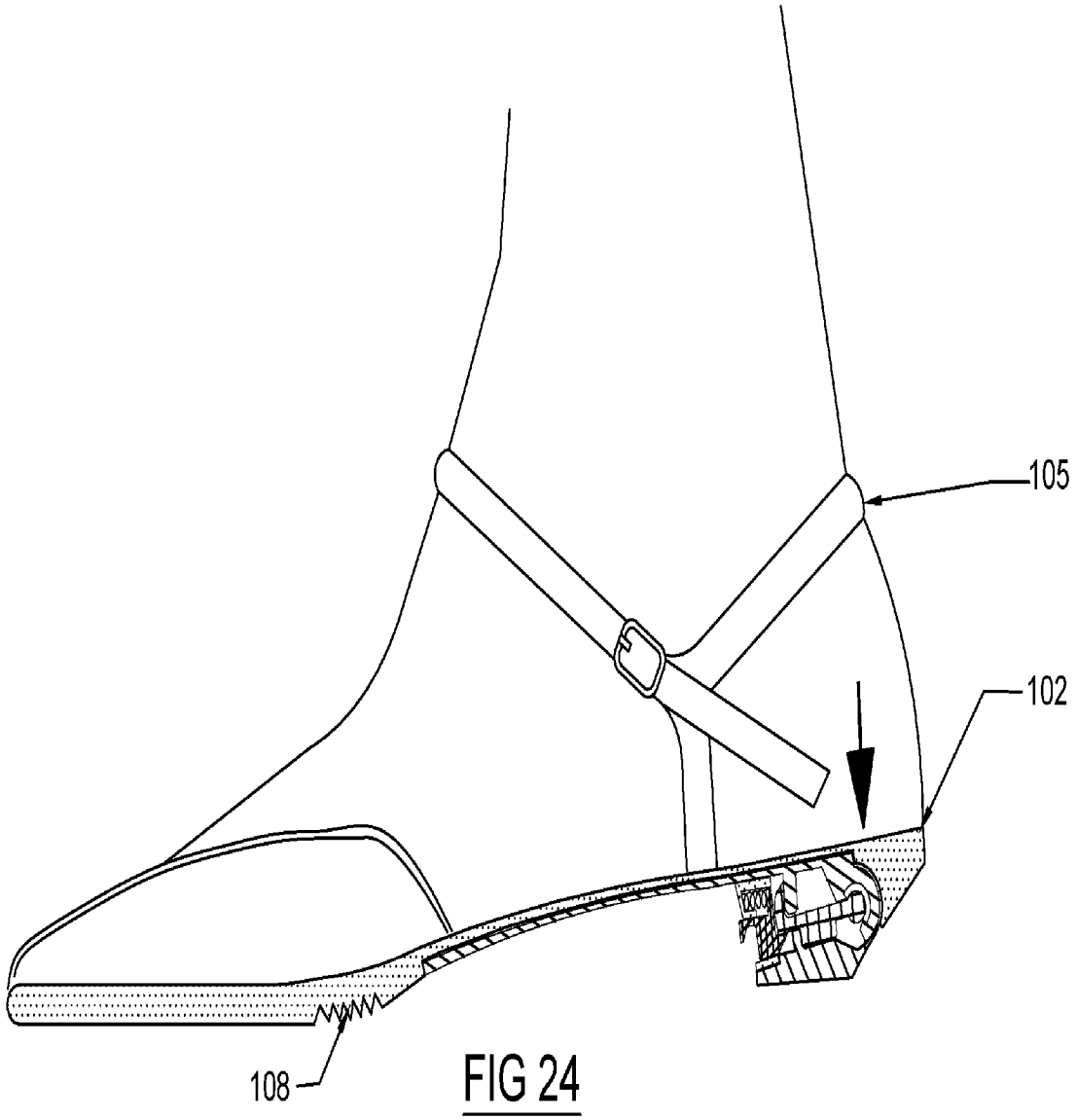

FIG. 24: a section view is shown. The low heel is inserted. The rear sole has been rotated to the low heel position using the living hinge.

Corresponding reference numerals indicate corresponding parts throughout the several views of the drawings.

DETAILED DESCRIPTION

Example embodiments will now be described more fully with reference to the accompanying drawings. As shown in FIGS. 1-24, a shoe 100 can have a front sole 101, a rear sole 102, a hinge 103, shoe full body 104, a shoe strap 105, a shoe body 106, a shoe elastic 107, a living hinge 108, a high heel 110, a low heel 120, a mid-heel 130, a button 140, a button spring 141, a button pull 142, a button ramp 143, a button lock 144, a shank 150, a shank receiver 151, a compression member 160, a heel hinge 170, a heel hinge pivot 171, a heel hinge lock 172, and a heel hinge ramp 173.

The present invention was developed as a result of research into the problem associated with making shoes with heels that can be detached and/or replaced with heels of different heights. The present invention provides a transformable shoe that provides the wearer with a combination of shoe styles. In one example, the present invention may be embodied in a customizable shoe kit that provides interchangeable heels with two or more heel heights. The shoe can transform from a high heel shoe to a low style shoe or somewhere in between. This is accomplished by providing a sole that can change angles to accommodate for different height heels. The sole comprises a front section and a rear section. The two sections can be connected with a hinge. The hinge allows the rear sole section to rotate to accommodate for different height heels.

The design of the sole of the invention solves the problem of discomfort present in current high heel shoes. In conventional high heel shoes, the sole from front to rear is a rigid frame. Embodiments of the present invention provide a hinge in the sole that provides some flexibility. The flexibility in the sole can reduce discomfort by balancing forces from the toes to the counteract instability in the heel area.

In the current method of construction of a high heel shoe the central part of the heel contains a post. The post is attached to a steel shank embedded in the sole of the shoes. The shank can be made of a flexible metal or other strong material. The shank can be flexible enough to provide the necessary strength within the sole to absorb the downward force from the weight of a person. The heel post generally comprises a rigid material and rigidly couples to the shank through a mortise and tenon like connection. In various embodiments, the heel post includes a notch configured to lock the heel post into the shank. The shank may be formed (e.g., through casting, machining, forging, etc.) using various metals, plastics, or other appropriate material that provides strength and rigidity. In various embodiments, a portion of the heel post slides into a slot in the shank and is locked in position by a release mechanism. However, other equivalent materials may be used accordingly to meet the design criteria of a particular implementation.

Also, there is a geometric distance from the ball of the foot to the heel. This geometric distance remains constant whether the shoe is in the low style position or it is in the high heel position. The sole rotates and changes angle from the low configuration to the high heel configuration and the distance from the ball of the foot to the heel does not change.

A significant comfort advantage over the conventional high heel shoes is the stability provided by the hinged connection between the front sole and the rear sole. This allows balancing forces from the front toe section to be applied to aid in controlling instability within the shoe when the high heel is attached. In one example, the hinged connection can be formed using a live hinge. For example, a flexible material may be used to connect the front sole and the rear sole.

The walking motion while wearing high heels can be different than low style shoes. The normal walking motion of wearing low style shoes can consist of the heel comes in contact with the floor or ground first. Than the persons weight is transferred to the arch of the foot and then finally the toes. The walking motion while wearing high heel shoes is different. The high heel can come in contact with the floor or ground and the same time as the toe section.

Embodiments of the present invention generally provide for replaceable heels of different heights or styles. The person can easily detach the high heel (e.g., by pushing or pulling a release button) and replace the high heel with a mid-height heel or low height heel, and vice versa. The person can also detach the heel and transform the shoe into a low style shoe. The heels can be stored easily, (e.g., in the person's purse). Wearing a low style shoe provides the wearer with more comfort and the walking motion is more natural. The person can easily transform the low styles shoes by attaching the high heel back onto the sole of the shoe.

Embodiments of the present invention may also provide for a fashion statement. The ability to replace heels can easily change the wardrobe. An example of this is replacing a black color high heel with a red color high heel to match the person's red purse. Replacement heels can also be different shapes or styles. An example of this is a cocktail waitress can replace her high heel with a high heel that is a 'martini' glass.

The height of the high heel can be of any height. The hinge can rotate to any angle to accommodate for the desired heel height. If an extremely high heel height is required, the rotation of the hinge might not be enough to accommodate for this. In this case a platform of a desired height can be added to the front toe section of the sole to accommodate for a higher heel height.

The shoe frames and heels in accordance with embodiments of the present invention can be transformed from a walking shoe, having a low heel height, to a shoe having a higher heel height, conveniently and rapidly. A high heel that is detachable and replaceable. In addition, the shape of the shoe frame can be changed to increase the comfort of the wearer depending on the height of the heel chosen.

The shoe frame as described below can be independent of the final appearance of the shoe which can vary according to the dictates of the shoe designer. The high strength shoe elements described herein are meant to be covered with standard liners, cushion material, uppers, sole coverings and heel coverings, which can be made of various materials known to those skilled in the art such as leather, various man made materials and resins, fabric and the like. The transformable heel can be made of metal other high strength material, which may be covered with leather, plastic, fabric, and the like, or can be made of other materials. The basic structure of the shoe frame in accordance with embodiments of the present invention is independent of the size, shape, type and materials which provide the final appearance of the shoe.

The present invention generally provides for a sole with two sections connected with a hinge that can rotate and change angles to accommodate different heel heights. The hinge described in the following drawings is a preferred method. The hinge can be accomplished by other methods other than the ones described below. The hinge can be a separate piece and attached to the sole. The sole can also be implemented with a live hinge (e.g., one continuous piece of flexible material capable of changing angles). Also, the sole can be one continuous piece of different materials integrated together as new technologies allow.

Heels of varying heights may be attached and detached to a shank in the sole of the shoe. The drawings are illustrative of a preferred embodiment of attachment and detachment of the heel to the sole. However, other methods of attachment, such as sliding into grooves, clipping, or snapping are envisioned.

The toe portion of the sole and the heel portion of the transformable shoe sole of the invention can be constructed in a variety of methods. Generally each portion of the sole can be constructed in one piece or layers of materials plied together. It can be made of an injection molded polymer or other synthetic material. The two piece sole may have a hinge type joint in the metatarsal region. This is the approximate location of where the ball of the foot of a person will be engaging. The hinge joint may have a built-in defined range of motion or may have an infinite amount of rotation. Contacting surfaces of the hinge may be texturized, for example, to cause some limited restriction to flexion and extension, and also to act as a shock absorber. Other ways of adjusting the angle of the individual portions of the shoe sole will suggest themselves to one skilled in the art, and are meant to be included herein.

It will be apparent that the shoe designer has a wide choice among the various embodiments shown here in both the shoe sole elements and the heel elements, depending on the ultimate design of the shoe, and relative heights of the high heel and the low heel versions. The shoe frame and heel as described above are not meant to be limited to the details described herein, but many variations thereof will be apparent to one skilled in the art. For example, the shoe frame can be made of additional portions so as to allow for greater variation of the contour of the sole and the relative positions of the arch with respect to the heel and toe portion of the shoe, thereby providing for a wide variation in design.

The detachable heel can, as an option, contain a sturdy pin in its interior to provide for structural support when weight is applied by the person stepping down on the sole of the shoe. The relative positions of the sole portion can be adjusted to allow for variations in the height and shape of the extended heel to be employed. Embodiments of a shoe frame and heel in accordance with the present invention may include, but are not limited to, the following parts The button 140, button spring 141, button pull 142, button ramp 143, and button lock 144 may be used in various combinations to implement a latching mechanism configured to manually and/or automatically lock the heel (110, 120, 130, etc.) when the respective heel is rotated into the shank 150.

FIG. 1 represents a view of a person wearing high heels 110 and carrying the low heels 120 in a purse, while FIG. 2 refers to a view of a person wearing low heels 120 and carrying the high heels 110 in a purse. FIG. 3 represents a shoe 100 having a removable heel 110. Depicted is an elevation view where the high heel 110 is fully inserted into the rear sole 102. Referring to FIG. 4: an elevation view is shown. The high heel 110 is being rotated to remove the heel 110 from the shoe 100.

Referring to FIG. 5: an elevation view is shown. The high heel 110 is being removed from the shank 150. As is shown, the interface between the heel and the rear sole 102 can be a compressible member which allows the heel to connect to the rear sole without movement between the two. FIG. 6: an elevation view depicting the coupling of a low heel 120 to the compression member and rear sole. The low heel 120 is being inserted into the shank 150.

FIG. 7 is and alternate low heel 120 into an alternate rear sole 102. The rear sole depicts a circular accepting female bearing which accepts a circular bearing on the low heel 120. The low heel 120 is inserted into the shank 150. FIG.

8 represents an elevation view of the heel 120 attached. The low heel 120 is fully rotated and the rear sole 110 has been rotated to the low position.

Referring to FIG. 9: a section view is shown. The high heel 110 is fully inserted and rotated into the shank 150. The button 140 having a locking member with spring a latch is shown in the in the locked position, with a heel hinge 170. Shown is a bearing shank which is inserted into a shank receiver 151. Referring to FIG. 10 a section view is shown. The button 140 is being pulled out to the unlocked position. This arrangement will allow removal of the heel.

FIGS. 11*a* and 11B depict a plan section views of a shoe 100 according to the present teachings. The button 140 depicted in a retracted position which is being pulled out to the unlocked position. This is done by the person pulling the button 142 out. The button 140 can be on the side of the rear sole 102, or in the center. Referring to FIG. 12: a section view is shown. The high heel 110 is being rotated out of engagement with the rear sole 102. The heel hinge 170 is being rotated within the shank receiver 151. FIG. 13 is a section view of the removal of heel 110. The high heel 110 is being removed from the shank 150. The heel hinge pivot 171 has been removed from the shank receiver 151. The button 140 is being sprung back into the locked position via the button spring 141.

Referring to FIG. 14: a section view is shown. The button 140 is in the locked position. The low heel 120 is being inserted. The heel hinge pivot 171 is being inserted into the shank receiver 151. Referring to FIG. 15: shows a heel hinge pivot 171 has been inserted into the shank receiver 151. The low heel 120 is being rotated up. The heel hinge ramp 173 is engaging the button ramp 143. This will force the button 140 out to the unlocked position.

Referring to FIGS. 16 and 17: a section view is shown. The button 140 is still pushed out in the unlocked position. low heel 120 is shown inserted and rotated up. The button spring 141 has pushed the button 140 to the locked position. The button lock 144 has engaged the heel hinge 170. This locks the low heel 120 into position.

Referring to FIGS. 18A-18B and 19: a plan section view is shown. The button 140 has been sprung to the locked position. The button 140 is shown on the side of the rear sole 102. It can be on the side or in the center of the rear sole 102. The rear sole 102 has been rotated to the low heel position using the hinge 103.

Referring to FIG. 20: a section view is shown. The mid heel 130 has been inserted and rotated up. The button 140 is in the locked position via the button spring 141. The rear sole 102 has been rotated to the mid heel position using the hinge 103.

Referring to FIG. 21: a section view is shown. The low heel 120 has been inserted. The rear sole 102 has been rotated to the low heel position using the hinge 103. This is a full body shoe and the full body 104 is indicated. The shoe elastic 107 has been stretched to accommodate the change in shape of the full body shoe in the low position.

Referring to FIG. 22: a section view is shown. The high heel 110 has been inserted. The rear sole 102 has been rotated to the high heel position using the hinge 103. This is a full body shoe and the full body 104 is indicated. The shoe elastic 107 has been compressed to accommodate the fully body shoe in the high heel position.

Referring to FIGS. 23 and 24, shown are section views according to the present teachings. The high heel 110 has been inserted. The rear sole 102 has been rotated to the high heel position using the living hinge 108. As described above, the low heel 120 has been inserted. The rear sole 102 has been rotated to the low heel position using the living hinge 108.

In the embodiments illustrated configuration enable the heels to be switched (exchanged) without removing the shoe. Thus, the embodiments illustrated may also be applied to shoes and boots.

The term dress shoes include a wide variety of shoes, e.g., opera pumps to high fashion shoes. Dress shoes can have a wide range of heel heights and shapes, from a modest 2 inch heel to a 4 or 5 inch stiletto heel. The higher the heel, the more difficult the shoes are to walk in for extended periods and distances than low heel shoes and they slow down the walker. Thus it has become the norm for people to wear low heeled walking shoes to and from work, and then to change shoes when they reach their place of business or the club for dancing. This necessitates someone carrying high heel shoes along with a pair of low walking shoes back and forth, or maintaining an extensive shoe wardrobe at the workplace.

In one example, a shoe may be built with a two piece sole capable of changing angles to allow for the attachment of different size heels could be produced. The shoe may serve as a low style shoe with a low heel, along with heels of various heights. Such a shoe may be worn comfortably as a low style shoe and then easily transformed into a high heel or other height heel shoes. Conversely, a high heel shoe may easily be transformed back into a mid-height heel, or a low style shoe again.

The high heels or mid-range heels that have been detached may be stored in the person's purse or other storage device. Other advantages of the replacement heel may include, but are not limited to: 1. The heel can also be replaced with a different heel of a different style or color. In the field of footwear, a need has been recognized for a more economical way to match the footwear to the person's wardrobe than having one or more pairs of shoes for each suit, dress, or casual outfit that a person my own. For example, red heels to match a red purse; 2. Replacement heels can be used to replace broken heels. High heels are sometimes easily broken when stepping off a curb or something similar. Replacing a heel is more economical that replacing a pair of shoes; 3. Replacement heels of various height heels. If a person is at an occasion that requires a mid-range heel, it can easily be replaced with just that; and 4. The heel can be replaced with a custom shape heel. Heels can be of different designs and shapes and can be easily attached to the shoe. An example of this would be a cocktail waitress can be wearing a set of heels that look like a "martini glass".

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

While the invention has been particularly shown and described with a reference to the preferred embodiments thereof, it will be understand by those skilled in the art that various changes in form and details may be made without departing from the scope of the invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shoe assembly comprising:

a front sole section having a front sole section rear edge;

a rear sole section comprising a rear sole section front edge, a shank, and a release button, wherein said shank includes a rear edge, side edges, a ridge passing from one of said side edge to the other, and a latching mechanism attached said release button, wherein said latching mechanism is configured to automatically lock said heel to said shank when said heel is inserted and rotated onto said shank;

a heel removably attached to said shank, wherein said heel is released from a locked position by said release button; and a hinge connecting said front sole section and said rear sole section, wherein said hinge is perpendicular to a longitudinal axis of the rear sole section.

2. The shoe assembly of claim 1, wherein: said rear sole section further comprises a rear sole section rear edge, said longitudinal axis of said rear sole section extending from approximately said rear sole section rear edge to approximately said rear sole section front edge, and said shank extending from front to rear along said rear sole section.

3. The shoe assembly of claim 2, wherein: said heel comprises a support rod configured to removably attach said heel to said shank; and engages said latching mechanism.

4. The shoe assembly of claim 3, wherein a compression member is inserted.

5. The shoe assembly of claim 4, wherein said support rod comprises a rigid material and is configured to be inserted into said compression member.

6. The shoe assembly of claim 5, wherein said support rod is rotated within said compression member.

7. The shoe assembly of claim 2, wherein said support rod engages said ridge.

8. The shoe assembly of claim 7, wherein said support rod is engaged and pushed into said compression member.

9. The shoe assembly of claim 2 wherein: said latching mechanism comprises a ramp configured to engage a ramp on said support rod.

10. The shoe assembly of claim 9, wherein said latching mechanism is configured to release said heel when said release button is activated.

11. A customizable shoe kit comprising: a shoe assembly including:

(i) a front sole section having a front sole section rear edge;

(ii) a rear sole section comprising a rear sole section front edge, a shank, and a release button;

(iii) a hinge connecting said front sole section and said rear sole section, wherein said hinge is perpendicular to a longitudinal axis of said rear sole section;

(iv) a selectively engagable plurality of heels, each of said plurality of heels removably attachable to said shank;

wherein when a particular one of said plurality of heels is attached to said shank, the particular one of said plurality of heels is released from a locked position by said release button; and wherein said shank includes a rear edge, side edges, a ridge passing from one of said side edge to the other, and a latching mechanism attached said release button, wherein said latching mechanism is configured to automatically lock said heel to said shank when said heel is inserted and rotated onto said shank.

* * * * *